United States Patent [19]

Källberg et al.

[11] 4,160,321

[45] Jul. 10, 1979

[54] PORTABLE GAS-MOTOR-DRIVEN CUTTING IMPLEMENT

[75] Inventors: Tommy K. Kallberg, Lindome; Bo Rangert, Mölnlycke, both of Sweden

[73] Assignee: Aktiebolaget Partner, Molndal, Sweden

[21] Appl. No.: 863,320

[22] Filed: Dec. 22, 1977

[30] Foreign Application Priority Data

Dec. 29, 1976 [SE] Sweden ..... 7614660

[51] Int. Cl.[2] ..... B27B 17/02

[52] U.S. Cl. ..... 30/383

[58] Field of Search ..... 30/383, 384, 385, 386, 30/387

[56] References Cited

U.S. PATENT DOCUMENTS

| | | | |
|---|---|---|---|
| 3,006,388 | 10/1961 | Root | 30/383 |
| 3,945,119 | 3/1976 | Nagashima | 30/383 |

*Primary Examiner*—Jimmy C. Peters

[57] ABSTRACT

A portable gas-motor-driven cutting implement has a motor unit combined with a fuel tank and supporting a tool carrier. The cutting implement is provided with a curved front handle member extending substantially transversely of the tool carrier and a rear handle at the rear of the motor unit. The front handle member and the rear handle form parts of a rigid, closed supporting frame connected to the motor unit by three widely spaced resilient members, two of which are arranged at the front of the motor unit while the third is arranged at the rear of the motor unit.

4 Claims, 5 Drawing Figures

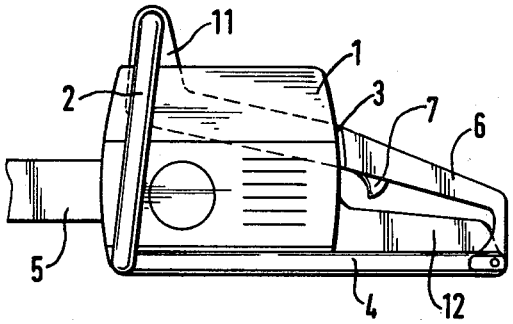
FIG. 1
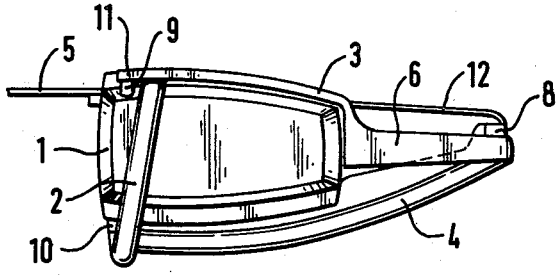
FIG. 2
FIG. 3
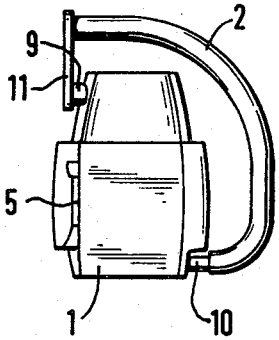
FIG. 4
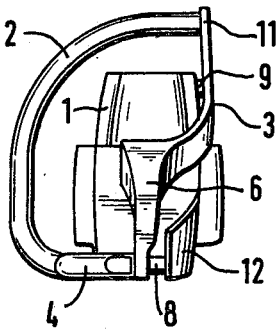
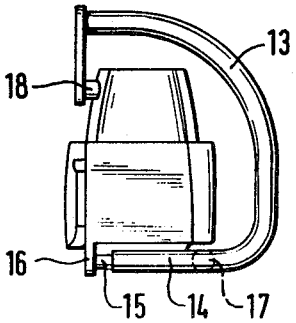
FIG. 5

PORTABLE GAS-MOTOR-DRIVEN CUTTING IMPLEMENT

BACKGROUND OF THE INVENTION

This invention relates to portable gas-motor-driven chain saws and other gas-motor-driven cutting implements required to be supported by an operator during the cutting operation. More particularly, the invention relates to a cutting implement of the type in which a fuel tank is combined with the gas-motor into a motor unit the front end of which supports a tool carrier extending forwards from the motor unit, for instance a guide bar for a cutter chain arranged to be driven by the motor, which is provided with means for carrying said motor unit including a curved front handle member extending substantially transversely of the longitudinal axis of the tool carrier and at least partially surrounding the front end of the motor unit and a handlebar member connected at its front extremity to an upper portion of said front handle member and having a handle portion located at the rear of the motor unit, said carrying means being connected to the motor unit by a plurality of resilient mounting members.

The system above referred to has important practical advantages. It is structurally simple, and the motor unit is easily accessible for servicing. On the other hand, the vibration suppression properties of existing cutting implements of the type described are not satisfactory. That is, uncomfortably large vibration amplitudes will occur in at least part of the range of speed of the motor.

SUMMARY OF THE INVENTION

The invention has for its principal object to provide a portable gas-motor-driven cutting implement of the general type above specified with provides a substantially increased degree of safety against the occurrence of undesirably strong vibrations in the handles under operating conditions, with no sacrifice of the control of the position of the tool to be effected by means of said handles.

In the implement according to the invention, the means for carrying the motor unit include, in addition to the curved front handle member and the handlebar member, a brace member connecting the rear extremity of the handle portion of the handlebar member with a lower portion of the curved front handle member; according to an important feature of the invention, the front handle member, the handlebar member and the brace member just referred to are rigidly connected with each other so as to form a rigid, closed frame, the resilient means connecting said rigid frame with the motor unit comprising a first resilient member connecting the front end of said rigid frame to a top portion of said motor unit, a second resilient member connecting the front end of said rigid frame to a bottom portion of said motor unit, and a third resilient member connecting a portion of said rigid frame located at the rear of said motor unit to a rear portion of said motor unit.

These and other objects, features and advantages of the present invention will become apparent from the following description of embodiments of the invention with reference to the accompanying drawings.

THE DRAWINGS

FIG. 1 is a lateral elevational view of a chain saw constituting one embodiment of the invention.

FIG. 2 is a view from above of the chain saw of FIG. 1.

FIGS. 3 and 4 are, respectively, a front view and a rear view of the chain saw of FIG. 1.

FIG. 5 is a front view of a chain saw constituting a second embodiment of the invention.

DESCRIPTION OF THE EMBODIMENTS

In the figures, details not required for the understanding of the invention have been left out.

The chain saw of FIGS. 1 to 4 has a motor unit 1 resiliently supported by a frame composed of a curved front handle 2, a handlebar 3 and a brace member 4. A guide bar 5 for a saw chain (not shown) is mounted on the front end of the motor unit. The saw chain is driven through conventional transmission means by the crankshaft of a twostroke motor forming part of the motor unit. As usual, the crankshaft forms right angles with the plane of the guide bar 5. The motor unit also includes the carburetter of the motor as well as an air filter, a starting mechanism and a fuel tank. If a lubricant container has to be provided for lubricating the saw chain, said container also will be included in the motor unit.

The curved front handle 2 is arranged at the front end of the motor unit 1 and extends substantially transversely of the longitudinal axis of the guide bar 5 along the upper side and the left side (as viewed from behind) of the motor unit. The upper end of the curved front handle 2 is rigidly connected to the front end of the handlebar 3. The lower end of the curved front handle 2, which is located on a level with the bottom plane of the motor unit, is rigidly connected to the front end of the brace member 4. The brace member 4 and the handlebar 3 are rigidly connected at their rear extremities so as to form a rigid, U-shaped member 3–4. Thus, the members 2, 3 and 4 together form a rigid frame surrounding the motor unit. The front portion of the handlebar 3 extends rearwards and downwards from the upper extremity of the curved front handle 2 and has a shape adapted to the shape of the side wall and part of the rear wall of the motor unit (FIG. 2). The rear portion of the handlebar 3 forms a handle 6 fitted with a trigger-shaped gas lever 7. The brace member 4 extends from the front extremity rigidly connected to the curved front handle 2 rearwards along the lower part of the left side wall of the motor unit to the rigid joint connecting the brace member with the handlebar member, said joint being provided at the rear end of the handle 6. The rear ends of the members 3, 4 are attached to a bracket member 12 extending rearwards from the motor unit 1 by means of a resilient mounting member 8 provided at the joint between the members 3, 4. Said bracket 12 also serves as a knuckle guard for the hand grasping the handle 6. The frame 2–4 is attached to the motor unit by two additional resilient mounting members 9, 10. The member 9 is arranged between the front extremity of the handlebar 3, said extremity forming an upstanding ear 11, and the right-hand sidewall of the motor unit near the upper edge of said sidewall. The other resilient mounting member 10 is arranged between the part of the frame where the curved front handle 2 and the brace member 4 are joined to each other and the left sidewall of the motor unit 1 near the lower edge of said sidewall.

The vibrations caused by the operation of the chain saw occur practically exclusively in planes parallel to the plane of the guide bar. Accordingly, the resilient mounting members 8–10 have to be designed so as to be capable of yielding to the vibrations so orientated. Preferably they are arranged in such a way that the vibrations will subject the resilient material (rubber etc.) of the mounting element to shearing stresses. Mounting elements of this type are well known and require no detailed description.

The resiliency of the resilient mounting elements should be chosen in such a way in relation to the mass of the rigid frame formed by the members 2–4 that the first-order resonance frequency of said rigid frame is lower than the lowest rate of rotation of the motor during operation of the saw chain.

The described features of the supporting means 2–4 and the means for the resilient suspension of the motor unit in said frame result in a considerable reduction of the vibration level in the handles compared to existing cutting implements of the type in question. The described shape and location of the brace member 4 provides an additional advantage by protecting the right leg of the operator from a direct contact with the strongly vibrating motor unit.

In the modified form of the chain saw illustrated in FIG. 5, the curved front handle 13 has a lower shank 14 extending transversely along the underside of the motor unit and attached by means of a resilient mounting member 15 to a lug 16 projecting downwards from the left (as viewed from behind) sidewall of the motor unit. A brace member similar to the brace member 4 of FIG. 1 is rigidly attached to the front handle 13 at 17. The resilient mounting member 18 corresponds to the resilient mounting member 9 of the embodiment according to FIGS. 1 to 4.

I claim:

1. A portable gas-motor-driven cutting implement comprising a motor unit comprising a gas-motor, a fuel tank attached to said gas-motor, and tool driving means operated by said motor, a tool carrier and a cutting tool supported thereby, said tool carrier being attached to said motor unit and extending forwards therefrom, and said tool being arranged to be driven by said motor through said driving means, means for carrying said motor unit, said means comprising, a curved front handle member extending substantially transversely of the longitudinal axis of the tool carrier and at least partially surrounding the front end of the motor unit, a handlebar member connected at its front extremity to an upper portion of said front handle member and having a handle portion located at the rear of the motor unit, and, a brace member connecting the rear extremity of said handle portion with a lower portion of said front handle, said front handle member, said handlebar member and said brace member being rigidly connected with each other so as to form a rigid, closed frame, and, resilient means connecting said rigid frame with said motor unit, said resilient means comprising, a first resilient member connecting the front end of said rigid frame to a top portion of said motor unit, a second resilient member connecting the front end of said rigid frame to a bottom portion of said motor unit, and, a third resilient member connecting a portion of said rigid frame located at the rear of said motor unit to a rear portion of said motor unit.

2. A portable gas-motor-driven cutting implement as claimed in claim 1 in which said third resilient member is arranged at the rear extremity of the handle portion of said handlebar member.

3. A portable gas-motor-driven cutting implement as claimed in claim 1 in which said third resilient member connects the rear extremity of the handle portion of the handlebar member with the rear extremity of a bracket member rigidly connected to and extending rearwards from the motor unit.

4. A portable gas-motor-driven cutting implement as claimed in claim 1 which comprises a knuckle guard member rigidly attached to the motor unit, said knuckle guard member extending along and being spaced from the handle portion of said handlebar member, said third resilient member connecting the rear extremity of said knuckle guard member to the rear extremity of said handle member.

* * * * *